US011430650B2

(12) United States Patent
Nishiguchi

(10) Patent No.: US 11,430,650 B2
(45) Date of Patent: Aug. 30, 2022

(54) QUADRUPOLE MASS SPECTROMETER

(71) Applicant: SHIMADZU CORPORATION, Kyoto (JP)

(72) Inventor: Masaru Nishiguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/272,734

(22) PCT Filed: Sep. 6, 2018

(86) PCT No.: PCT/JP2018/033081
§ 371 (c)(1),
(2) Date: Mar. 2, 2021

(87) PCT Pub. No.: WO2020/049694
PCT Pub. Date: Mar. 12, 2020

(65) Prior Publication Data

US 2021/0351028 A1 Nov. 11, 2021

(51) Int. Cl.
*H01J 49/42* (2006.01)
*H01J 49/04* (2006.01)
*H01J 49/10* (2006.01)

(52) U.S. Cl.
CPC ..... *H01J 49/4215* (2013.01); *H01J 49/0422* (2013.01); *H01J 49/0445* (2013.01); *H01J 49/105* (2013.01); *H01J 49/4255* (2013.01)

(58) Field of Classification Search
CPC ..... H01J 49/0422; H01J 49/0431; H01J 49/0445; H01J 49/105; H01J 49/4215; H01J 49/4255
See application file for complete search history.

(56) References Cited

U.S. PATENT DOCUMENTS 4,209,696 A * 6/1980 Fite ..... H01J 49/04 250/281
4,535,235 A * 8/1985 McIver, Jr. ..... H01J 49/4215 250/282
10,290,482 B1 * 5/2019 Yamada ..... H01J 49/24
2002/0027196 A1 * 3/2002 Shiokawa ..... H01J 49/4215 250/288
2005/0017167 A1 * 1/2005 Franzen ..... H01J 49/4225 250/288
2005/0199802 A1 9/2005 Ueno
(Continued)

FOREIGN PATENT DOCUMENTS

JP 2001-283769 A 10/2001
JP 2005-259481 A 9/2005
WO 2016/092696 A1 6/2016

OTHER PUBLICATIONS

International Search Report of PCT/JP2018/033081 dated Oct. 30, 2018 [PCT/ISA/210].
(Continued)

*Primary Examiner* — David E Smith
(74) *Attorney, Agent, or Firm* — Sugrhrue Mion, PLLC

(57) ABSTRACT

A quadrupole mass spectrometer includes: a quadrupole mass filter with four rod electrodes arranged so as to surround a central axis; and a magnet that forms a magnetic field in at least a part of an inside of the quadrupole mass filter in a direction intersecting the central axis.

11 Claims, 6 Drawing Sheets

(56) References Cited

U.S. PATENT DOCUMENTS

| | | | | |
|---|---|---|---|---|
| 2006/0071162 | A1* | 4/2006 | Crawford | H01J 49/4255 250/290 |
| 2015/0136969 | A1* | 5/2015 | Wildgoose | H01J 49/0045 250/282 |

OTHER PUBLICATIONS

Written Opinion of PCT/JP2018/033081 dated Oct. 30, 2018 [PCT/ISA/237].
Decision of Refusal dated Jan. 20, 2022 from the Japanese Patent Office in JP Application No. 2020-540953.
Notice of Reasons for Refusal dated Nov. 10, 2021 from the Japanese Patent Office in Japanese Application No. 2020-540953.

* cited by examiner

QUADRUPOLE MASS SPECTROMETER

CROSS REFERENCE TO RELATED APPLICATIONS

This application is a National Stage of International Application No. PCT/JP2018/033081, filed Sep. 6, 2018.

TECHNICAL FIELD

The present invention relates to a quadrupole mass spectrometer.

BACKGROUND ART

The mass spectrometer is the device that separates and detects ions derived from sample molecules according to the mass-to-charge ratio (m/z). A quadrupole mass spectrometer is widely used as the mass spectrometer of compact and having excellent resolution. The quadrupole mass spectrometer is a device that performs mass analysis in which an AC electric field is applied to four rod electrodes called a quadrupole mass filter arranged so as to surround the central axis to generate an oscillating electric field that allows only ions with a predetermined mass-to-charge ratio to pass through.

In the quadrupole mass spectrometer, the measurement target is often a mixture of the sample molecule to be analyzed and a low-reactivity carrier gas such as helium. Therefore, in order to improve the measurement accuracy, it is necessary to separate the sample molecule to be analyzed from the carrier gas molecule and measure it.

It is described in Patent Literature 1 (PTL 1) that, by providing electrodes facing each other across an ion optical axis between the ion source and the quadrupole mass filter and forming a predetermined AC electric field between the electrodes, relatively light ions are greatly deflected and thereby most of the relatively light carrier ions are prevented from entering the quadrupole mass filter.

CITATION LIST

Patent Literature

PTL 1: Japanese Laid-Open Patent Publication No. 2005-259481

SUMMARY OF INVENTION

Technical Problem

Even if the method of PTL 1 is used, the carrier gas enters the quadrupole mass filter, although the ratio is small. On the central axis of the quadrupole mass filter, the electric field formed by the four rod electrodes arranged so as to surround the central axis is zero, so that the quadrupole mass filter does not function to ions incident along the central axis thereof, as a mass filter. Therefore, the carrier gas-derived ions incident along the central axis of the quadrupole mass filter pass through the quadrupole mass filter and reach the ion detector to generate noise.

Ionized sample and carrier gas-derived ions spread near the central axis and enter the quadrupole mass filter at various angles of incidence, so that the proportion of ions incident along the central axis, that is, the proportion of ions incident through the central axis in parallel to the central axis is extremely low.

However, since the amount of carrier gas (number of molecules) is much larger than the amount of the sample, even if only a small portion of the carrier gas-derived ions remains and enters the quadrupole mass filter, large noise is generated, reducing the measurement accuracy.

Solution to Problem

A quadrupole mass spectrometer, according to the 1st aspect includes: rod electrodes arranged so as to surround a central axis; and a magnet that forms a magnetic field in at least a part of an inside of the quadrupole mass filter in a direction intersecting the central axis.

The quadrupole mass spectrometer according to the 2nd aspect is in the quadrupole mass spectrometer according to the 1st aspect, it is preferable that: the magnet forms the magnetic field at where at least a part between an entrance end of the quadrupole mass filter and a middle point in a longitudinal direction of the quadrupole mass filter.

The quadrupole mass spectrometer according to the 3rd aspect is in the quadrupole mass spectrometer according to the 1st aspect, it is preferable that: a collision cell and a second quadrupole mass filter, arranged at after stage of the quadrupole mass filter.

The quadrupole mass spectrometer according to the 4th aspect is in the quadrupole mass spectrometer according to the 3rd aspect, it is preferable that: the quadrupole mass spectrometer further comprises: a second magnet that forms a magnetic field inside the second quadrupole mass filter in the direction intersecting a central axis of the second quadrupole mass filter.

The quadrupole mass spectrometer according to the 5th aspect is in the quadrupole mass spectrometer according to the 1st aspect, it is preferable that: the quadrupole mass spectrometer further comprises: a flight tube that is arranged at after stage of the quadrupole mass filter.

The quadrupole mass spectrometer according to the 6th aspect is in the quadrupole mass spectrometer according to any one of the 1st to 5th aspect, it is preferable that: the quadrupole mass spectrometer further comprises: a gas sample ionization apparatus that ionizes analysis target carried by carrier gas.

The quadrupole mass spectrometer according to the 7th aspect is in the quadrupole mass spectrometer according to any one of the 1st to 5th aspect, it is preferable that: the quadrupole mass spectrometer further comprises: a liquid sample ionization apparatus that ionizes analysis target carried by carrier liquid.

The quadrupole mass spectrometer according to the 8th aspect is in the quadrupole mass spectrometer according to any one of the 1st to 4th aspect, it is preferable that: the quadrupole mass spectrometer further comprises: an inductively coupled plasma ionization apparatus.

The quadrupole mass spectrometer according to the 9th aspect is in the quadrupole mass spectrometer according to any one of the 1st to 5th aspect, it is preferable that: the magnet is an electromagnet, and the quadrupole mass spectrometer further comprises: a current control unit that controls current supplied to the electromagnet.

The quadrupole mass spectrometer according to the 10th aspect is in the quadrupole mass spectrometer according to the 9th aspect, it is preferable that: the current control unit sets an amount of current supplied to the electromagnet according to a mass-to-charge ratio of an ion of analysis target.

The quadrupole mass spectrometer according to the 11th aspect is in the quadrupole mass spectrometer according to the 10th aspect, it is preferable that: the current control unit sets a larger amount of current to flow through the electromagnet as the mass-to-charge ratio of the ion of the analysis target is higher.

Advantageous Effects of Invention

According to the present invention, it is possible to realize a quadrupole mass spectrometer, which is capable of effectively separating a gas of small molecular weight such as a carrier gas and having high measurement accuracy.

DESCRIPTION OF EMBODIMENTS

Quadrupole Mass Spectrometer according to the first embodiment

Figure 1A:
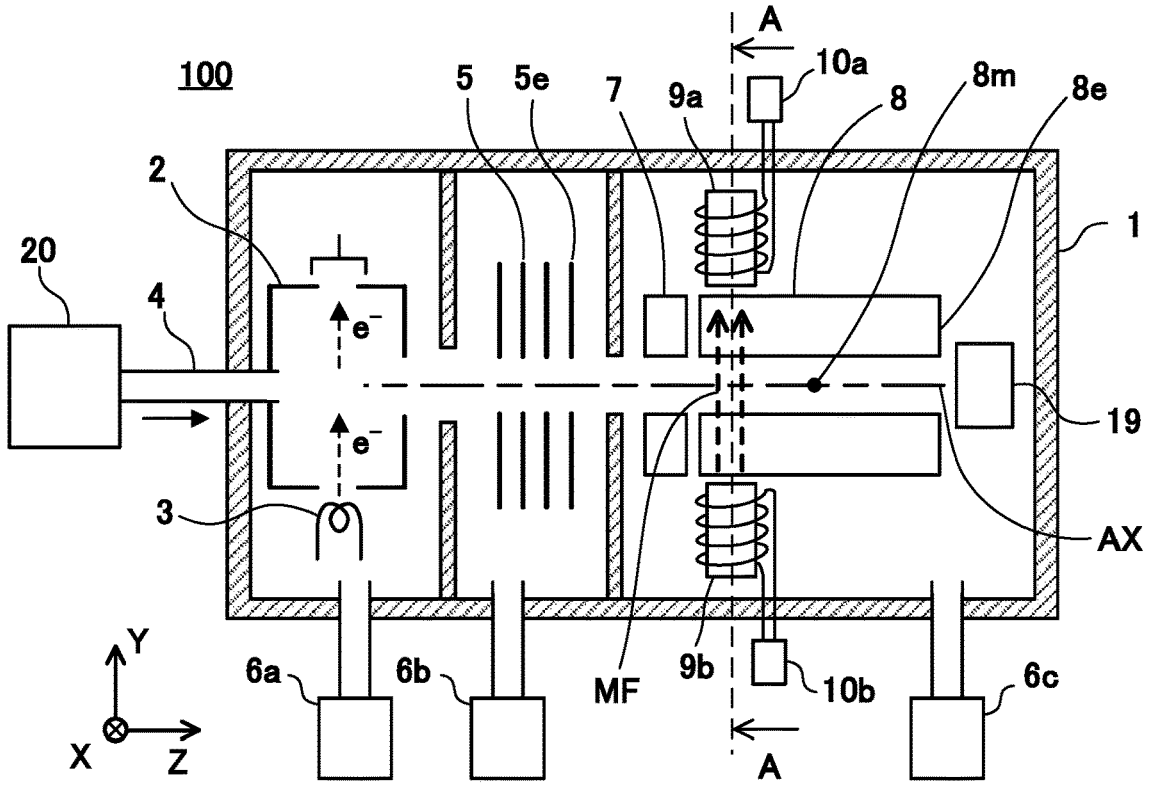
FIGS. 1(*a*) and 1(*b*) are schematic views showing a configuration of a quadrupole mass spectrometer according to the first embodiment, FIG. 1(*a*) is a side sectional view of the quadrupole mass spectrometer, and FIG. 1(*b*) is a cross-sectional view at the AA cross section in FIG. 1(*a*).
Figure 1B:
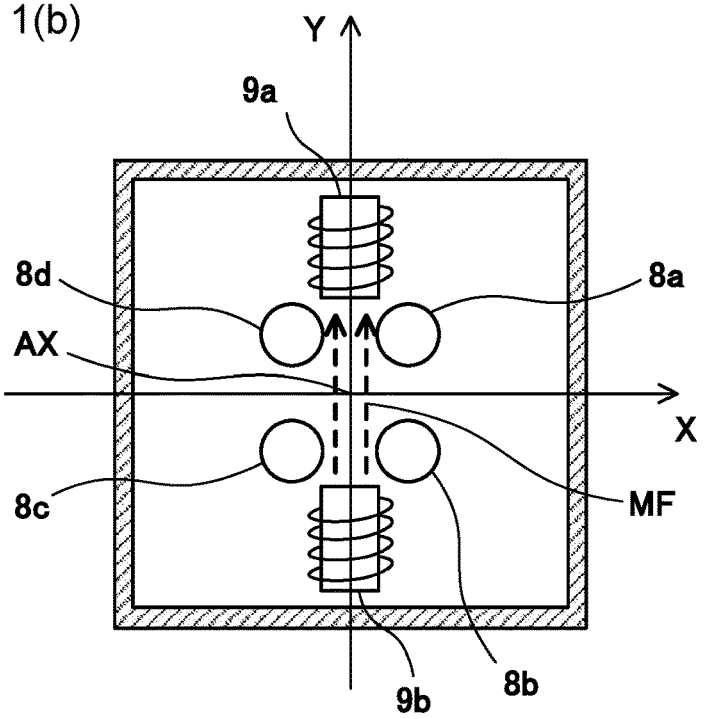

FIGS. 1(*a*) and 1(*b*) are schematic views showing a configuration of a quadrupole mass spectrometer 100 according to the first embodiment of the present invention, FIG. 1(*a*) is a side sectional view of the quadrupole mass spectrometer 100, and FIG. 1(*b*) is a cross-sectional view at the AA cross section in FIG. 1(*a*) viewed from the +Z direction. In the quadrupole mass spectrometer 100, along the central axis AX inside a vacuum container 1, an ionization chamber 2, an ion optical system 5, a pre-rod 7, a quadrupole mass filter 8, and an ion detector 19 are provided. The vacuum container 1 is substantially sealed and inside thereof is evacuated by vacuum pumps 6*a*, 6*b*, and 6*c*.

It is to be noted, the direction of the Z axis shown in FIG. 1(*a*) coincides with the direction of the central axis AX of the quadrupole mass filter 8.

A gas chromatograph device 20 is provided at a precedent stage of the quadrupole mass spectrometer 100, and a sample gas flowing out of the gas chromatograph device 20 is supplied into the ionization chamber 2 via a connecting pipe 4. The ionization chamber 2 is an example of a gas sample ionization apparatus that ionizes an analysis target being carried by a carrier gas by an electron impact method. In the ionization chamber, thermo electrons generated at the filament 3 are accelerated and come into contact with sample molecules (or atoms) having introduced into the ionization chamber 2, so that the sample molecules are ionized.

Into the ionization chamber 2, in addition to the sample molecules as the analysis target, a large amount of molecules of helium gas, which are the mobile phase (carrier gas) of a column of the gas chromatograph, also flow into and are ionized.

Generated various ions are drawn out from the ionization chamber 2 and are introduced into the pre-rod 7 through the ion optical system 5. The pre-rod 7 is provided with four rod electrodes surrounding the central axis AX at positions separated from the central axis AX by a predetermined distance. The positions of the four rod electrodes of the pre-rod 7 with respect to the central axis AX are similar to those of four rod electrodes of 8*a* to 8*d* of the quadrupole mass filter 8 described later.

The ions that have passed through the pre-rod 7 are introduced into the quadrupole mass filter 8. As shown in FIG. 1(*b*), the quadrupole mass filter 8 is provided with four rod electrodes 8*a* to 8*d* so as to surround the central axis AX. Each of the four rod electrodes 8*a* to 8*d* is arranged at a position separated from the central axis AX by a predetermined distance. The length of the four rod electrodes in the direction along the central axis AX is about 15 to 30 cm.

To the quadrupole mass filter 8, a voltage superimposed a DC voltage and a high-frequency voltage is applied from a power supply (not shown), and only ions having a mass-to-charge ratio (mass m/charge z) corresponding to the applied voltage pass through the quadrupole mass filter 8 and reach the ion detector 19 and are detected. Other unnecessary ion species cannot pass through the quadrupole mass filter 8.

However, on the central axis AX of the quadrupole mass filter 8, the electric field formed by the four rod electrodes of 8*a* to 8*d* arranged so as to surround the central axis AX is zero, so that the quadrupole mass filter 8 does not function to ions enter along the central axis AX of the quadrupole mass filter 8, as a mass filter. Thus, ions (carrier gas-derived ions) such as carrier gas entering along the central axis AX of the quadrupole mass filter 8 pass through the quadrupole mass filter 8 and reach the ion detector 19 and may cause noise.

In the first embodiment, as an example, magnets 9*a* and 9*b* are arranged in the vicinity of the incident side (ionization chamber 2 side) of the quadrupole mass filter 8, thereby, a magnetic field MF in a direction intersecting the central axis AX is formed at least in a part of inside the quadrupole mass filter 8.

The magnets 9*a* and 9*b* are electromagnets as an example, and current control units 10*a* and 10*b* supply currents to the electromagnets 9*a* and 9*b*, respectively, and at the same time, control the amount of the currents for supplying. As shown in FIG. 1(*b*), the direction of the magnetic field MF is parallel to the Y direction as an example, and the magnetic field MF parallel to the Y direction is formed inside the four rod electrodes of 8*a* to 8*d* that constituting the quadrupole mass filter 8.

The direction of the magnetic field MF is not limited to the above, and may be set to any direction as long as it is not parallel to the central axis AX, that is, the direction intersects the central axis AX. In a case the direction of the magnetic field MF is orthogonal to the central axis AX, ions can be excluded from the quadrupole mass filter 8 with a smaller magnetic field MF as described later.

Normally, the four rod electrodes of 8*a* to 8*d* constituting the quadrupole mass filter 8 are formed of non-magnetic (paramagnetic) material, so that the rod electrodes of 8*a* to 8*d* do not affect the formed magnetic field MF. Therefore, the relationship of the direction of the magnetic field MF and the positions of the rod electrodes of 8*a* to 8*d* may be arbitrary. That is, the positions where the magnets 9*a* and 9*b* are arranged are not limited to on the Y-axis as shown in FIG. 1(*b*), may be arranged on the X-axis, or may be arranged at the position where rotated in an arbitrary angle from the X-axis or the Y-axis with the central axis AX as the center.

Figure 2:
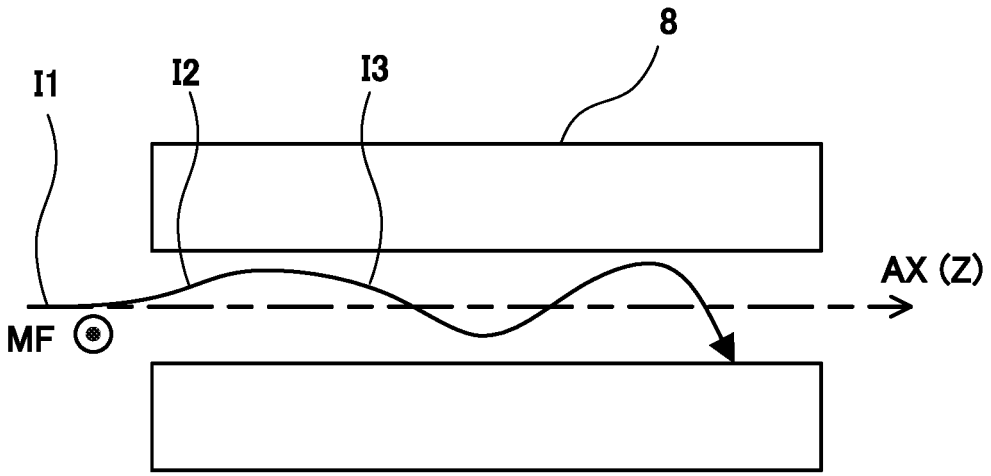
FIG. 2 is a diagram illustrating a principle that a carrier gas is separated by a magnetic field.

FIG. 2 is a diagram showing how the orbit I1 of an ion moving through the quadrupole mass filter 8 bends under Lorentz Force generated by the magnetic field MF formed by the magnets 9*a* and 9*b*. FIG. 2 is a diagram of the quadrupole mass filter 8 viewed from a position away in the direction of the magnetic field MF perpendicular to the central axis AX.

As described above, in a case the magnetic field MF is absence, no electric field is formed on the central axis AX, and the ions entering the quadrupole mass filter 8 along the central axis AX pass through the quadrupole mass filter 8 along the central axis AX.

On the other hand, in a case there is the magnetic field MF in the quadrupole mass filter 8, Lorentz Force ($qv \times B$: q is the electric charge, v is the velocity of the ion, B is the magnetic field MF) due to the magnetic field MF acts to the ions in the direction orthogonal to the magnetic field MF. As a result, the ions having traveled on the orbit I1 that is along the central axis AX are deflected upward in FIG. 2 by the magnetic field MF and pass through along the orbit 12. Since the orbit 12 is away from the central axis AX, an electric field by the quadrupole mass filter 8 acts on the ions, and if the mass-to-charge ratio of the ions is different from the mass-to-charge ratio that can pass through the quadrupole mass filter 8, the ions are subjected to the deflection action by the electric field and are excluded from the quadrupole mass filter 8 through the orbit 13.

Since the kinetic energy ($\frac{1}{2} \cdot mv^2$) of the ion incident on the quadrupole mass filter 8 is determined by the potential difference between the ionization chamber 2 and the quadrupole mass filter 8, the energy of ion is substantially constant regardless of the mass m of the ion. Therefore, the velocity v of the ion is inversely proportional to the square root of the mass m (gym) of the ion.

Since Lorentz Force is a force proportional to the velocity of the ion as described above, a relatively low-mass ion having a faster velocity v receives a larger force. Therefore, by forming a magnetic field MF in the quadrupole mass filter 8, ions derived from a carrier gas, which is generally low-mass helium or nitrogen, can be efficiently excluded from the quadrupole mass filter 8.

The orbit of a relatively large mass ion of the analysis target is also deflected by the magnetic field MF in the quadrupole mass filter 8. However, as described above, since the velocity v of an ion having a large mass is slow and Lorentz Force acting thereto is small, the amount of orbit deflection is small. Then the ion having a large mass is not excluded to outside the quadrupole mass filter 8.

As a result, noise caused by the carrier gas can be reduced, and a quadrupole mass spectrometer with high measurement accuracy can be realized.

Although the magnets 9*a* and 9*b* may be either permanent magnets or electromagnets, by using electromagnets, a magnitude and direction of the magnetic field MF formed in the quadrupole mass filter 8 can be adjusted by controlling amount of current flowing through the electromagnets.

As an example, the amount of current flowing through the electromagnets can be set according to the mass-to-charge ratio of the ion of analysis target. For example, the higher the mass-to-charge ratio of the ion of analysis target, the larger the amount of current flowing through the electromagnets can be set. Since the ion of analysis target has a large mass-to-charge ratio and the ion orbit is hard to change due to the magnetic field MF, even if the amount of current is increased to form a magnetic field MF in strong, the decrease in detection of ion strength in the ion detector 19 is hard to occur. On the other hand, carrier gas-derived ion has a low-mass and is efficiently removed by increasing in the magnetic field MF with increasing in current. Therefore, by setting the amount of current flowing through the electromagnets according to the mass-to-charge ratio of the ion of analysis target, the S/N of the measurement result can be improved and the measurement accuracy can be further improved.

On the other hand, in a case that permanent magnets are used as the magnets 9*a* and 9*b*, the power supply units 12*a* and 12*b* and wiring are not required, and the cost of the magnets 9*a* and 9*b* itself can also be reduced and the magnetic field MF can be generated by a simple and inexpensive configuration.

In the above example, the magnets 9*a* and 9*b* are arranged in the vicinity of the entrance side of the quadrupole mass filter 8. However, as long as the magnetic field MF affects the orbit of the carrier gas having a small mass, the positions where the magnets 9*a* and 9*b* are arranged are not limited to this configuration. That is, the magnets 9*a* and 9*b* may be arranged so that the magnetic field MF is formed in at least a part of the inside of the quadrupole mass filter 8 in the direction intersecting the central axis AX. For example, the magnets 9*a* and 9*b* may be arranged at a position away from the quadrupole mass filter 8 inside the vacuum container 1 and, or may also be arranged outside the vacuum container 1. Further, it may be a constitution where a magnetic material may be arranged between the magnets 9*a* and 9*b* and the entrance side of the quadrupole mass filter 8 to guide the magnetic field of the magnets 9*a* and 9*b* to the entrance side of the quadrupole mass filter 8. Each of the magnets 9*a* and 9*b* does not have to be a single magnet, and may be a plurality of magnets. Further, the magnets 9*a* and 9*b* do not have to be paired as described above, and may be one magnet.

It is to be noted, as described above, the carrier gas-derived ions traveling on the orbit along the central axis AX are deflected by the magnetic field MF, then deflected by the action of the electric field of the quadrupole mass filter 8, and are excluded outside the quadrupole mass filter 8. Therefore, in order to more efficiently eliminate the carrier gas-derived ions, it is preferable that the magnets 9*a* and 9*b* are arranged so that, the magnetic field MF is formed at where at least a part between an entrance end 8*e* of the quadrupole mass filter 8 and a middle point 8*m* in the longitudinal direction (central axis AX direction) of the quadrupole mass filter 8. Thereby, the carrier gas-derived ions traveling on the orbit along the central axis AX can be deflected by the magnetic field MF at an early stage, and then the electric field by the quadrupole mass filter 8 can be acted for a relatively long time. As a result, the carrier gas-derived ions can be more efficiently excluded from the quadrupole mass filter 8.

It is to be noted, a magnetic field can be formed also at the position between the final stage electrode 5*e* of the ion optical system 5 and the entrance end 8*e* of the quadrupole mass filter 8 in a direction intersecting the central axis AX direction to deflect the carrier gas-derived ions entering the quadrupole mass filter 8 by this magnetic field.

Further, the gas sample ionization apparatus is not limited to the ionization chamber 2 adopting the above-mentioned electron impact method, and an apparatus by a chemical ionization method may also be used.

Variation 1

Figure 3:
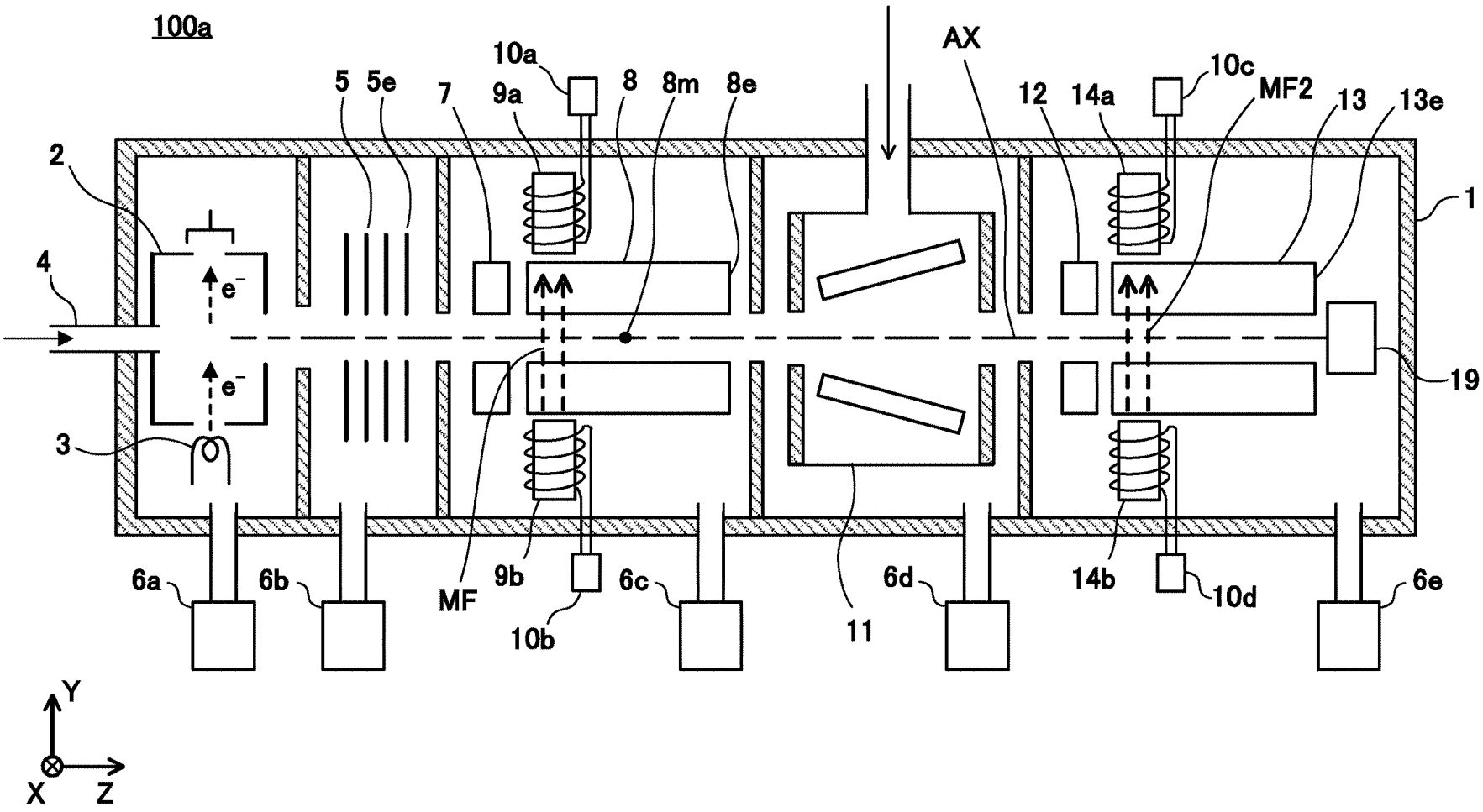
FIG. 3 is a schematic view showing a configuration of a quadrupole mass spectrometer according to the variation 1.

FIG. 3 is a schematic view showing a configuration of a quadrupole mass spectrometer 100*a* according to the variation 1. Since the configuration of the quadrupole mass spectrometer 100*a* according to the variation 1 is common in many parts to the quadrupole mass spectrometer 100 according to the first embodiment described above, the same reference signs are given to the common parts, and the description thereof will be omitted as appropriate.

The quadrupole mass spectrometer 100*a* according to the variation 1 has the same configuration from an ionization chamber 2 to a quadrupole mass filter 8 as those of the quadrupole mass spectrometer 100 according to the first embodiment described above. The quadrupole mass spectrometer 100*a* according to the variation 1 is a so-called triple quadrupole mass spectrometer in which a collision cell 11 and a second quadrupole mass filter 13 are arranged at after stage of the quadrupole mass filter 8. In a vacuum container 1, a portion where the collision cell 11 is arranged and a portion where the second quadrupole mass filter 13 is arranged are respectively evacuated by vacuum pumps 6*d* and 6*e*.

It is to be noted, in FIG. 3, a gas chromatograph device 20 is not shown. Corresponding to the name of the second quadrupole mass filter 13, the quadrupole mass filter 8 is referred to as a first quadrupole mass filter 8.

The ions (precursor ions) that have passed through the first quadrupole mass filter 8 enter the collision cell 11 and collide with the inert gas (collision gas) such as argon or nitrogen supplied to the collision cell 11. Upon collision, the precursor ions are cleaved at weak chemical bond portions to produce product ions. Various product ions generated enter the second quadrupole mass filter 13 via a second pre-rod 12, only ions having a predetermined mass-to-charge ratio pass through the second quadrupole mass filter 13, and detected by the ion detector 19.

However, also in the second quadrupole mass filter 13, the electric field of the second quadrupole mass filter 13 does not act on the ions enter along the central axis AX. Therefore, in the present variation 1, second magnets 14*a* and 14*b* are arranged in the vicinity of an entrance side (collision cell 11 side) of four rod electrodes constituting the second quadrupole mass filter 13 to form a magnetic field MF2 at the vicinity of the entrance side where is at least a part in the second quadrupole mass filter 13. The second magnets 14*a* and 14*b* are electromagnets as an example, and current control units 10*c* and 10*d* supply currents to the second electromagnets 14*a* and 14*b*, respectively, and at the same time, control the amount of the currents for supplying.

It is to be noted, the positions where the second magnets 14*a* and 14*b* are arranged are not limited to the above. The second magnets 14*a* and 14*b* may also be arranged so as to form the magnetic field MF2 inside the second quadrupole mass filter 13 in a direction intersecting the central axis AX, similarly to the magnets 9*a* and 9*b* described above.

Further, similar to the magnets 9*a* and 9*b* described above, it is preferable that also the second magnets 14*a* and 14*b* are arranged so that, the magnetic field MF2 is formed between an entrance end 13*e* of the second quadrupole mass filter 13 and a middle point 13*m* in the longitudinal direction of the second quadrupole mass filter 13.

In a case where the magnets 14*a* and 14*b* are not arranged as in the conventional constitution, among the ions such as argon ion and nitrogen ion ionized in the collision cell 11, those enter the second quadrupole mass filter 13 along the central axis AX are detected by the ion detector 19 as noise.

In the present variation 1, the ions enter the second quadrupole mass filter 13 along the central axis AX are deflected by the magnetic field MF2 formed by the magnets 14*a* and 14*b* and deviate from the central axis AX. Therefore, an ion having a mass-to-charge ratio other than the mass-to-charge ratio that can pass through the second quadrupole mass filter 13 cannot pass through the second quadrupole mass filter 13 due to the electric field of the second quadrupole mass filter 13. Thereby, the noise component can be reduced.

It is to be noted, in a case where collision gas ions generated in the collision cell 11 have a small effect on measurement result, the magnets 14*a* and 14*b* do not necessarily have to be arranged around the second quadrupole mass filter 13. Even in this case, the noise caused by the carrier gas is reduced by forming a magnetic field MF on the entrance side of the first quadrupole mass filter 8, and a triple quadrupole mass spectrometer with high measurement accuracy can be realized.

Variation 2

Figure 4:
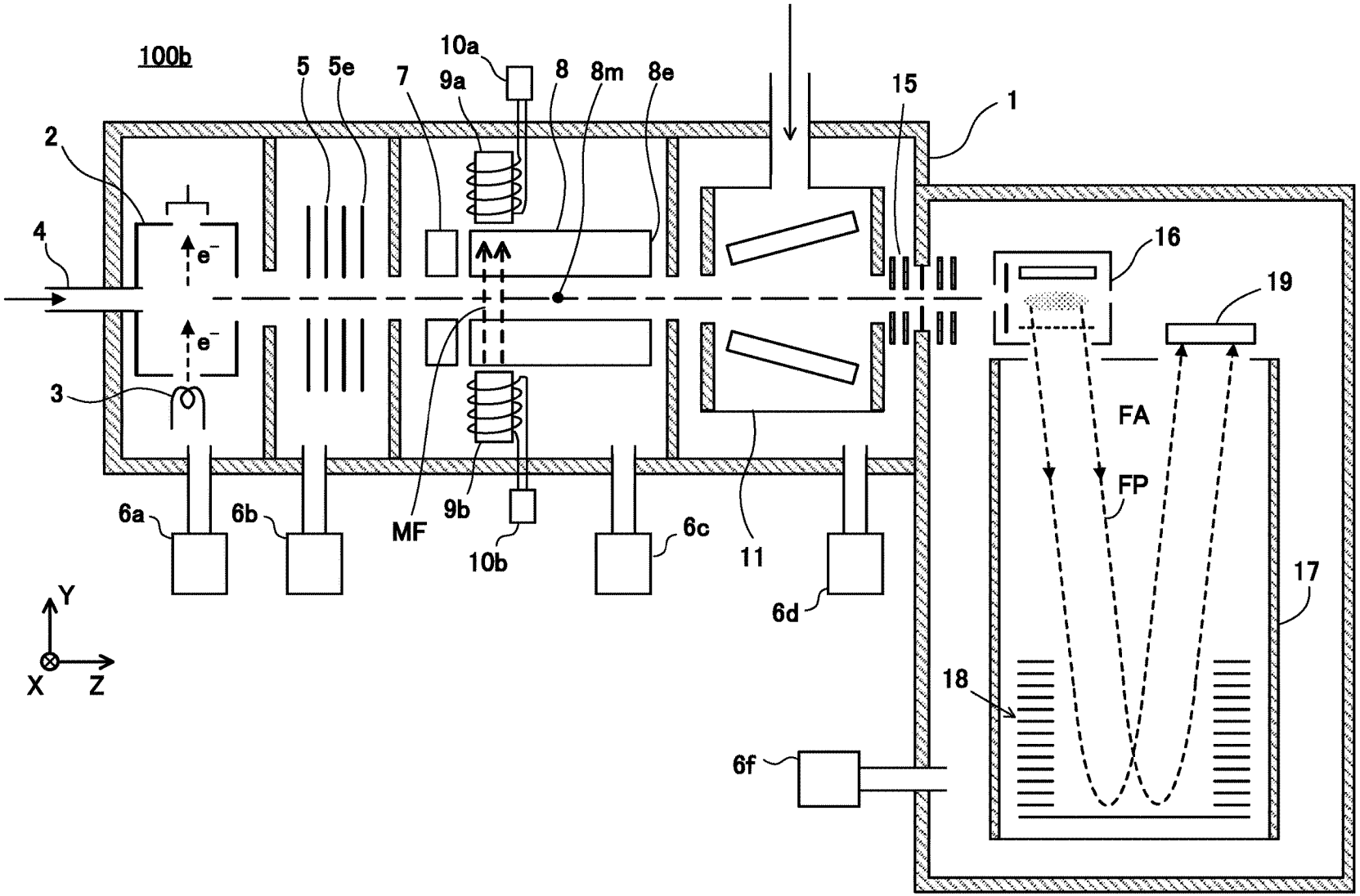
FIG. 4 is a schematic view showing a configuration of a quadrupole mass spectrometer according to the variation 2.

FIG. 4 is a schematic view showing a configuration of a quadrupole mass spectrometer 100*b* according to the variation 2. Since the configuration of the quadrupole mass spectrometer 100*b* according to the variation 2 is common in many parts to above described the quadrupole mass spectrometer 100 according to the first embodiment or the quadrupole mass spectrometer 100*a* according to the variation 1, the same reference signs are given to the common parts, and the description thereof will be omitted as appropriate.

The quadrupole mass spectrometer 100*b* according to the variation 2 has the same configuration from an ionization chamber 2 to a quadrupole mass filter 8 as those of the quadrupole mass spectrometer 100 according to the first embodiment described above. The quadrupole mass spectrometer 100*b* according to the variation 2 is a so-called quadrupole-time of flight (QTOF) mass spectrometer in which a collision cell 11 and a flight tube 17 are arranged at after stage of the first quadrupole mass filter 8. In a vacuum container 1, a portion where the collision cell 11 is arranged and a portion where the flight tube 17 is arranged are respectively evacuated by vacuum pumps 6*d* and 6*f*.

Various product ions generated in the collision cell 11 are guided by an ion optical system 15 and enter an orthogonal acceleration electrode 16. Then, the ions are accelerated by the orthogonal acceleration electrode 16 to the −Y direction in FIG. 4, and fly in a flight space FA in the flight tube 17 along a flight path FP. Further, the ions are reflected by an electric field formed by a reflector 18 and detected by an ion detector 19.

Since velocities of various product ions accelerated by the orthogonal acceleration electrode 16 differ depending on the difference in the mass-to-charge ratio of the product ions, the flight times required for flying along the same flight path FP differs depending on the difference in the mass-to-charge ratio of the ions. Therefore, by measuring the flight time, the mass-to-charge ratio of various product ions can be obtained.

Also in the quadrupole mass spectrometer 100*b* according to the variation 2, noise caused by the carrier gas can be reduced by forming the magnetic field MF in the first quadrupole mass filter 8, so that a quadrupole-time of flight mass spectrometer with high measurement accuracy can be realized.

Quadrupole Mass Spectrometer According to Second Embodiment

Figure 5:
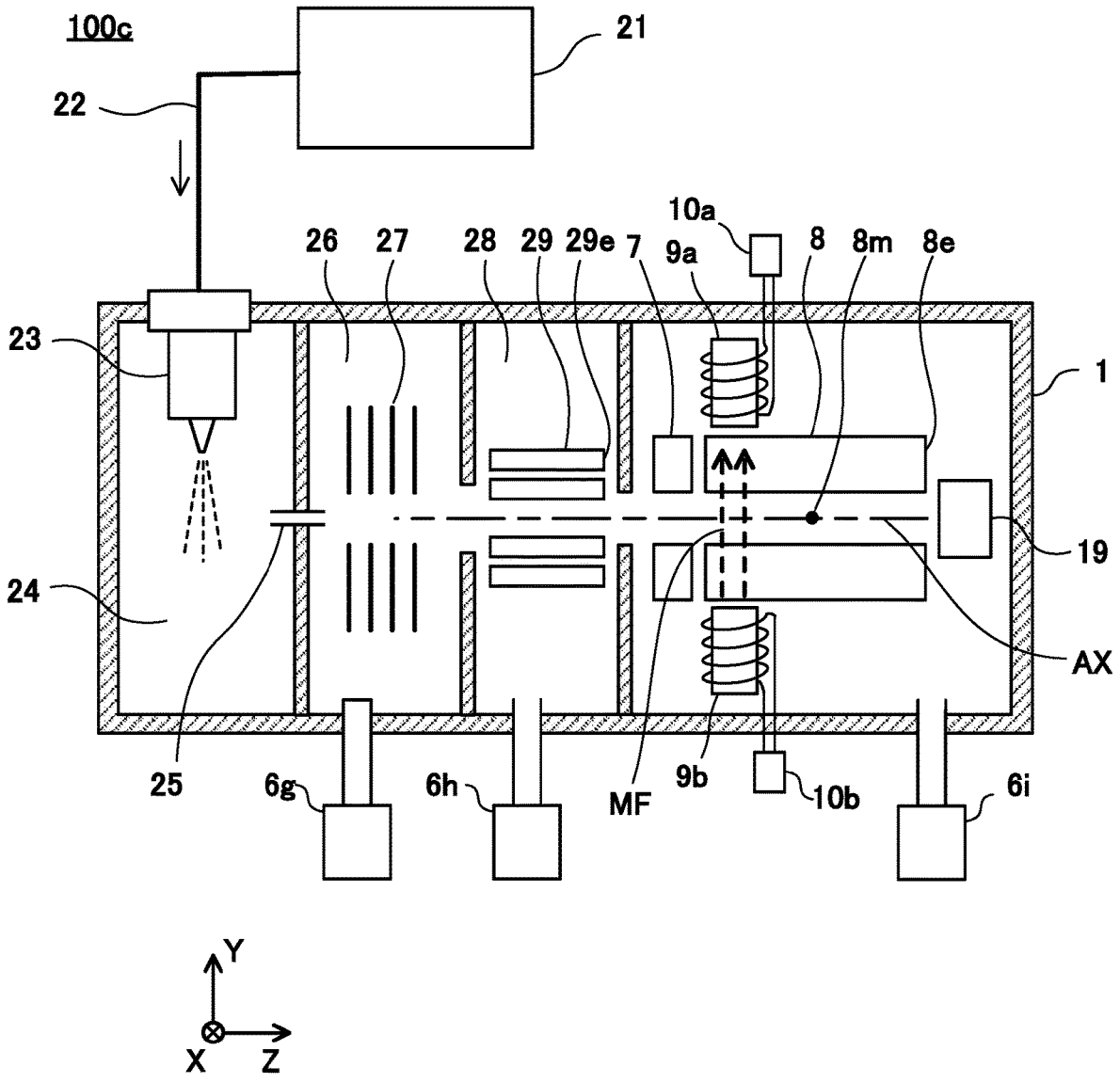
FIG. 5 is a schematic view showing a configuration of a quadrupole mass spectrometer according to the second embodiment.

FIG. 5 is a schematic view showing a configuration of a quadrupole mass spectrometer 100*c* according to the second embodiment. Since a part of the configuration of the quadrupole mass spectrometer 100*c* according to the second embodiment is common to the quadrupole mass spectrometer 100 according to the first embodiment described above, the same reference signs are given to the common parts, and the description thereof will be omitted as appropriate.

In the quadrupole mass spectrometer 100*c* according to the second embodiment, an apparatus using ESI (Electrospray ionization) as a liquid sample ionization apparatus for ionizing an analysis target carried by a carrier liquid is used.

Liquid sample supplied from a liquid chromatograph device 21 is guided to an electrospray 22 by an introduction pipe 32. The electrospray 23 sprays the sample into an ionization chamber 24 together with nebulizer gas such as nitrogen while adding electric charge to the sample of liquid. The sample of liquid sprayed repeatedly evaporates and divides in the ionization chamber 24 to become ions of the sample molecule. Further, a part of nebulizer gas and mobile phase liquid (carrier liquid) of the liquid chromatograph device 21 is also ionized. The mobile phase liquid is generally water or organic solvent such as acetonitrile, both of which are low-mass molecules.

These ions enter a first intermediate vacuum chamber 26 through a heating capillary 25 of a small diameter. Then, the ions are guided by an ion optical system 27 provided in the first intermediate vacuum chamber 26 and further enter a second intermediate vacuum chamber 28. The second intermediate vacuum chamber 28 is also provided with an ion optical system 29, and ions of the sample molecule and ions generated by being ionized the nebulizer gas and the liquid component of the mobile phase of the liquid chromatograph device 21 are guided by the ion optical system 29 to enter a pre-rod 7 and a quadrupole mass filter 8.

In a vacuum container 1, a space where the first intermediate vacuum chamber 26 is provided, a space where the second intermediate vacuum chamber 28 is provided, and a space where the quadrupole mass filter 8 is provided are respectively being depressurized by the vacuum pumps 6*g*, 6*h*, and 6*i*.

Also in the present second embodiment, as in the first embodiment described above, magnets 9*a* and 9*b* are arranged in the vicinity of an entrance side of four rod electrodes 8*a* to 8*d* constituting the quadrupole mass filter 8. By the magnets 9*a* and 9*b*, a magnetic field MF is formed in the direction intersecting the central axis AX in at least a part of the inside the quadrupole mass filter 8. It is to be noted, the arrangement of the magnets 9*a* and 9*b* is not limited to the vicinity of the entrance side of the rod electrodes 8*a* to 8*d* similar to the case of the first embodiment described above. Also, similar to the first embodiment described above, it is further preferable that the magnets 9*a* and 9*b* are arranged so that, the magnetic field MF is formed between an entrance end 8*e* of the quadrupole mass filter 8 and a middle point 8*m* in the longitudinal direction of the quadrupole mass filter 8.

The magnets 9*a* and 9*b* are electromagnets as an example, and current control units 10*a* and 10*b* supply currents to the electromagnets 9*a* and 9*b*, respectively, and control the amount of the supplied currents. Thereby, low-mass ions derived from nebulizer gas and the liquid of the mobile phase of the liquid chromatograph device 21 can be efficiently removed to the outside the quadrupole mass filter 8 by the magnetic field MF formed on the entrance side of the quadrupole mass filter 8. As a result, noise caused by the nebulizer gas or the like can be reduced, and a quadrupole mass spectrometer with high measurement accuracy can be realized.

In the above example, it is described that the liquid sample supplied from the liquid chromatograph device 21 is ionized by the ESI method, but the ionization method is not limited to this. Besides this method, the atmospheric pressure chemical ionization method (APCI) and the atmospheric pressure photoionization source (APCI) can also be used.

As in the same manner of the variation 1 described above, also in the quadrupole mass spectrometer 100*c* according to the second embodiment described above, a collision cell 11 and a second quadrupole mass filter 13 may be installed at after stage of the quadrupole mass filter 8 to constitute a triple quadrupole mass spectrometer.

Further, as the same manner of the variation 2 described above, a collision cell 11, an orthogonal acceleration electrode 16, and a flight tube 17 may further be installed at after stage of the quadrupole mass filter 8 to constitute a quadrupole-time of flight mass spectrometer.

Quadrupole Mass Spectrometer According to Third Embodiment

Figure 6:
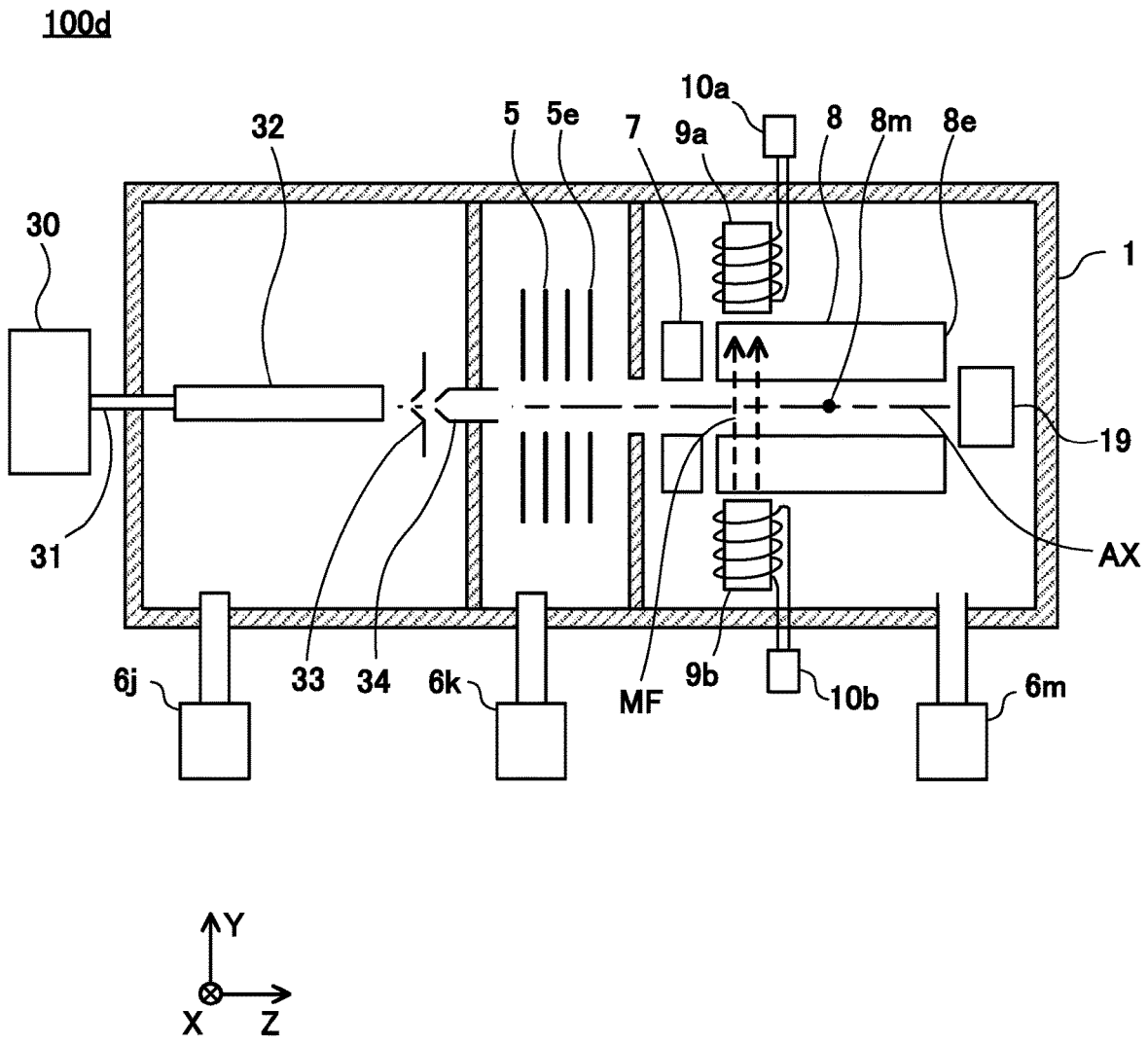
FIG. 6 is a schematic view showing a configuration of a quadrupole mass spectrometer according to the third embodiment.

FIG. 6 is a schematic view showing a configuration of a quadrupole mass spectrometer 100*d* according to the third embodiment. Since a part of the configuration of the quadrupole mass spectrometer 100*d* according to the third embodiment is common to the quadrupole mass spectrometer 100 according to the first embodiment described above, the same reference signs are given to the common parts, and the description thereof will be omitted as appropriate.

The quadrupole mass spectrometer 100*d* according to the third embodiment ionizes molecules of sample by inductively coupled plasma (ICP).

The sample supplied to a nebulizer 30 is mixed with carrier gas in the nebulizer 30 and then is made like a mist. The mist-like sample is introduced into an ICP torch 32 together with the carrier gas via an introduction unit 31, and is decomposed and ionized by plasma formed in the ICP torch 32.

The ions ejected from the ICP torch 32 enter an ion optical system 5 via a sampler cone 33 and a skimmer cone 34, are converged by the ion optical system 5, and enter a pre-rod 7 and a quadrupole mass filter 8.

Also in the present third embodiment, as in the first embodiment described above, magnets 9*a* and 9*b* are arranged in the vicinity of an entrance side of four rod electrodes 8*a* to 8*d* constituting the quadrupole mass filter 8. Also in the third embodiment, the preferred formation location of a magnetic field MF and the preferred arrangement positions of the magnets 9*a* and 9*b* are similar to those in the first embodiment described above. The magnets 9*a* and 9*b* are electromagnets as an example, and current control units 10*a* and 10*b* supply currents to the electromagnets 9*a* and 9*b*, respectively, and control the amount of the supplied currents.

Thereby, low-mass ions derived from carrier gas can be efficiently removed to the outside the quadrupole mass filter 8 by the magnetic field MF formed on the entrance side of the quadrupole mass filter 8. As a result, noise caused by the carrier gas can be reduced, and a quadrupole mass spectrometer with high measurement accuracy can be realized.

As in the same manner of the variation 1 described above, also in the quadrupole mass spectrometer 100*c* according to the third embodiment described above, a collision cell 11 and a second quadrupole mass filter 13 may be further installed at after stage of the quadrupole mass filter 8 to constitute a triple quadrupole mass spectrometer.

According to the above-described embodiments and variations, the following advantageous effects can be obtained.

(1) The quadrupole mass spectrometers 100 according to each of the above-mentioned embodiments and variations comprises: a quadrupole mass filter 8 with four rod electrodes 8*a* to 8*d* arranged so as to surround a central axis AX; and magnets 9*a* and 9*b* that form a magnetic field MF in at least a part of an inside of the quadrupole mass filter 8 in a direction intersecting the central axis AX. With this configuration, low-mass ions derived from carrier gas or the like can be efficiently excluded from the quadrupole mass filter 8. As a result, noise caused by carrier gas or the like can be reduced, and a quadrupole mass spectrometer with high measurement accuracy can be realized.

(2) By configuring so that the magnets 9*a* and 9*b* form the magnetic field at where at least a part between the entrance end 8*e* of the quadrupole mass filter 8 and the middle point 8*m* in a longitudinal direction of the quadrupole mass filter 8, it is possible to reduce noise caused by the carrier gas or the like more efficiently.

(3) By configuring so that the collision cell 11 and the second quadrupole mass filter 13 are arranged at after stage of the quadrupole mass filter 8, it is possible to realize a triple quadrupole mass spectrometer in which noise caused by the carrier gas or the like is reduced.

(4) By configuring so that the second magnets 14*a* and 14*b* that forms the magnetic field MF2 inside the second quadrupole mass filter 13 in the direction intersecting a central axis AX of the second quadrupole mass filter 13, it is possible to realize a triple quadrupole mass spectrometer in which noise caused by collision gas or the like is reduced.

(5) By configuring so that the collision cell 11 and the flight tube 17 are arranged at after stage of the quadrupole mass filter 8, it is possible to realize a quadrupole-time of flight (QTOF) mass spectrometer in which noise caused by carrier gas or the like is reduced.

(6) By configuring so that the gas sample ionization apparatus (such as the ionization chamber 2) that ionizes analysis target carried by carrier gas is provided, it is possible to realize a triple quadrupole mass spectrometer that efficiently analyzes the sample having been output from the gas chromatograph device 20.

(7) By configuring so that the liquid sample ionization apparatus (such as ESI 23) that ionizes analysis target carried by carrier liquid is provided, it is possible to realize a quadrupole mass spectrometer that efficiently analyzes the sample having been output from the liquid chromatograph device 21.

(8) Even in a case where configuring that the inductively coupled plasma ionization apparatus (ICP torch 32) is provided with, noise caused by carrier gas of the inductively coupled plasma ionization apparatus can be reduced, therefore, an inductively coupled plasma quadrupole mass spectrometer with high measurement accuracy can be realized.

(9) By configuring so that, the magnets 9*a* and 9*b* are electromagnets and the quadrupole mass spectrometers having the current control units 10*a* and 10*b* that control currents supplied to the electromagnets, it is possible to easily change the direction and magnitude of the magnetic field MF formed inside the quadrupole mass filter 8. Thereby, the degree of exclusion of carrier gas-derived ions from the quadrupole mass filter 8 can be adjusted according to the analysis target.

(10) By configuring so that each of the current control units 10*a* and 10*b* sets an amount of current supplied to the electromagnets 9*a* and 9*b*, respectively according to mass-to-charge ratio of ion of analysis target, S/N of measurement result is improved, and measurement accuracy can be further improved.

The present invention is not limited to the contents of the above embodiments. Other aspects conceivable within the scope of the technical idea of the present invention are also included within the scope of the present invention.

REFERENCE SIGNS LIST

100 . . . Quadrupole Mass Spectrometer, 1 . . . Vacuum Container,
2, 24 . . . Ionization Chamber, 3 . . . Filament, 4 . . . Connecting Pipe,
5, 15 . . . Ion optical system, 6*a*-6*m* . . . Vacuum Pump, 7, 12 . . . Pre-rod,
8 . . . Quadrupole Mass Filter, 8*a*-8*d* . . . Rod Electrode, 19 . . . Ion Detector,
9*a*, 9*b* . . . Magnet, 14*a*, 14*b* . . . Second Magnet,
10*a*-10*d* . . . Current Control Unit, 11 . . . Collision Cell,
13 . . . Second Quadrupole Mass Filter, 16 . . . Orthogonal Acceleration Unit,
17 . . . Flight Tube, FA . . . Flight Space, FP . . . Flight Path,
18 . . . Reflector, 20 . . . Gas Chromatograph Device,
21 . . . Liquid Chromatograph Device, 23 . . . Electrospray (ESI),
30 . . . Nebulizer, 32 . . . ICP Torch

The invention claimed is:

1. A quadrupole mass spectrometer, comprising:

a quadrupole mass filter with four rod electrodes arranged inside a vacuum container and arranged so as to surround a central axis; and a magnet that forms a magnetic field in at least a part of an inside of the quadrupole mass filter in a direction intersecting the central axis; wherein the magnetic field deflects ions travelling in a first orbit and a second orbit different from the first orbit, and the vacuum chamber is evacuated to a pressure lower than 0.01 Pa.

2. The quadrupole mass spectrometer according to claim 1, wherein:

the magnet forms the magnetic field at least at a location between an entrance end of the quadrupole mass filter and a middle point in a longitudinal direction of the quadrupole mass filter.

3. The quadrupole mass spectrometer according to claim 1, further comprising:

a collision cell and a second quadrupole mass filter, arranged at a stage after the quadrupole mass filter.

4. The quadrupole mass spectrometer according to claim 3, further comprising:

a second magnet that forms a magnetic field inside the second quadrupole mass filter in the direction intersecting a central axis of the second quadrupole mass filter.

5. The quadrupole mass spectrometer according to claim 1, further comprising:

a flight tube that is arranged at a stage after the quadrupole mass filter.

6. The quadrupole mass spectrometer according to claim 1, further comprising:

a gas sample ionization apparatus that ionizes analysis target carried by carrier gas.

7. The quadrupole mass spectrometer according to claim 1, further comprising:

a liquid sample ionization apparatus that ionizes analysis target carried by carrier liquid.

8. The quadrupole mass spectrometer according to claim 1, further comprising:

an inductively coupled plasma ionization apparatus.

9. The quadrupole mass spectrometer according to claim 1, wherein:

the magnet is an electromagnet, and the quadrupole mass spectrometer further comprises:

a current control unit that controls current supplied to the electromagnet.

10. The quadrupole mass spectrometer according to claim 9, wherein:

the current control unit sets an amount of current supplied to the electromagnet according to a mass-to-charge ratio of an ion of analysis target.

11. The quadrupole mass spectrometer according to claim 10, wherein:

the current control unit sets a larger amount of current to flow through the electromagnet as the mass-to-charge ratio of the ion of the analysis target is higher.

* * * * *